US008777681B1

(12) United States Patent
McNalley et al.

(10) Patent No.: US 8,777,681 B1
(45) Date of Patent: Jul. 15, 2014

(54) SYSTEMS AND METHODS FOR MANEUVERING A MARINE VESSEL

(75) Inventors: Brett J. McNalley, Oshkosh, WI (US); Michael J. Lemancik, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 214 days.

(21) Appl. No.: 12/971,892

(22) Filed: Dec. 17, 2010

(51) Int. Cl.
*B63H 5/20* (2006.01)
*B63H 5/125* (2006.01)
*B63H 20/08* (2006.01)

(52) U.S. Cl.
USPC ..... 440/53

(58) Field of Classification Search
USPC ..... 440/1, 3, 53, 61 S, 84; 114/144 R, 114/144 RE, 144 A, 144 B; 701/21
See application file for complete search history.

(56) References Cited

U.S. PATENT DOCUMENTS 6,234,853 B1 5/2001 Lanyi et al.
6,447,349 B1 * 9/2002 Fadeley et al. ..... 440/41
6,994,046 B2 2/2006 Kaji et al.
7,131,385 B1 * 11/2006 Ehlers et al. ..... 114/145 R
7,267,068 B2 9/2007 Bradley et al.
7,305,928 B2 * 12/2007 Bradley et al. ..... 114/144 R
7,429,202 B2 * 9/2008 Yazaki et al. ..... 440/53
7,467,595 B1 * 12/2008 Lanyi et al. ..... 114/144 R
7,883,383 B2 * 2/2011 Larsson ..... 440/1

* cited by examiner

*Primary Examiner* — Daniel V Venne
(74) *Attorney, Agent, or Firm* — Andrus Intellectual Property Law, LLP

(57) ABSTRACT

Systems for maneuvering a marine vessel comprise a plurality of marine propulsion devices that are movable between an aligned position to achieve of movement of the marine vessel in a longitudinal direction and/or rotation of the marine vessel with respect to the longitudinal direction and an unaligned position to achieve transverse movement of the marine vessel with respect to the longitudinal direction. A controller has a programmable circuit and controls the plurality of marine propulsion devices to move into the unaligned position when a transverse movement of the marine vessel is requested and to thereafter remain in the unaligned position after the transverse movement is achieved. Methods of maneuvering a marine vessel comprise requesting transverse movement of the marine vessel with respect to a longitudinal direction and operating a controller to orient a plurality of marine propulsion devices into an unaligned position to achieve the transverse movement, wherein the plurality of marine propulsion devices remain in the unaligned position after the transverse movement is achieved.

2 Claims, 5 Drawing Sheets

SYSTEMS AND METHODS FOR MANEUVERING A MARINE VESSEL

FIELD

The present disclosure relates to systems and methods for maneuvering marine vessels.

BACKGROUND

U.S. Pat. Nos. 6,234,853 and 7,467,595 are incorporated herein by reference and disclose methods and apparatuses for maneuvering multiple engine marine vessels.

U.S. Pat. No. 7,267,068 is incorporated herein by reference and discloses methods and apparatuses for maneuvering multiple engine marine vessels. A computer controller controls operation of a pair of marine propulsion devices that are each rotatable about a respective vertical axis. The controller receives user inputs from a joystick and controls the rotational position and output of the propulsion devices to move the marine vessel in a direction commensurate with the position of the joystick. When the joystick is transversely moved away from its vertical position, the marine propulsion devices are moved out of longitudinal alignment to achieve a resultant thrust vector that moves the marine vessel in the direction of joystick movement. When the joystick is thereafter returned to its vertical position, the marine propulsion devices are correspondingly moved back into longitudinal alignment.

SUMMARY

The present disclosure derives from the present inventors' research and development of improved systems and methods for maneuvering marine vessels. Through experimentation, the inventors have recognized that prior art systems and methods for maneuvering marine vessels employ unnecessary movement of propulsion devices, which can thereby result in undesired rotation or yaw of the marine vessel and/or undesired surge or backwards movement of the marine vessel. The inventors have identified this to be a problem that can not only negatively impact the handling of the marine vessel, but can also cause unsettling disturbances for individuals on the vessel. In addition, unnecessary motion of the propulsion devices can undesirably wear on steering actuators and other related components associated with rotating the devices.

In one example according to the present disclosure, systems for maneuvering a marine vessel comprise a plurality of marine propulsion devices that are movable between an aligned position to achieve movement of the marine vessel in a longitudinal direction and/or rotation of the marine vessel with respect to the longitudinal direction and an unaligned position to achieve transverse movement of the marine vessel with respect to the longitudinal direction. A controller having a programmable circuit is configured to control the plurality of marine propulsion devices to move into in the unaligned position when a transverse movement of the marine vessel is requested and to thereafter remain in the unaligned position after the transverse movement is achieved.

In another example, the controller controls movement of the plurality of marine propulsion devices to remain in the unaligned position when movement of the marine vessel in the longitudinal direction that is below a predetermined magnitude is subsequently requested.

In another example, the controller controls movement of the plurality of marine propulsion devices into the aligned position when movement of the marine vessel in the longitudinal direction that is above a predetermined magnitude is subsequently requested.

In another example, the controller controls movement of the plurality of marine propulsion devices into the aligned position when rotational movement of the marine vessel is subsequently requested.

In other examples, methods of maneuvering a marine vessel comprise requesting transverse movement of the marine vessel with respect to a longitudinal direction and operating a controller to orient a plurality of marine propulsion devices into an unaligned position to achieve the transverse movement, wherein the plurality of marine propulsion devices remain in the unaligned position after the transverse movement is achieved.

Further examples will be apparent to one having ordinary skill in the art from the following description and related drawing figures.

DETAILED DESCRIPTION OF THE DRAWINGS

Figure 2:
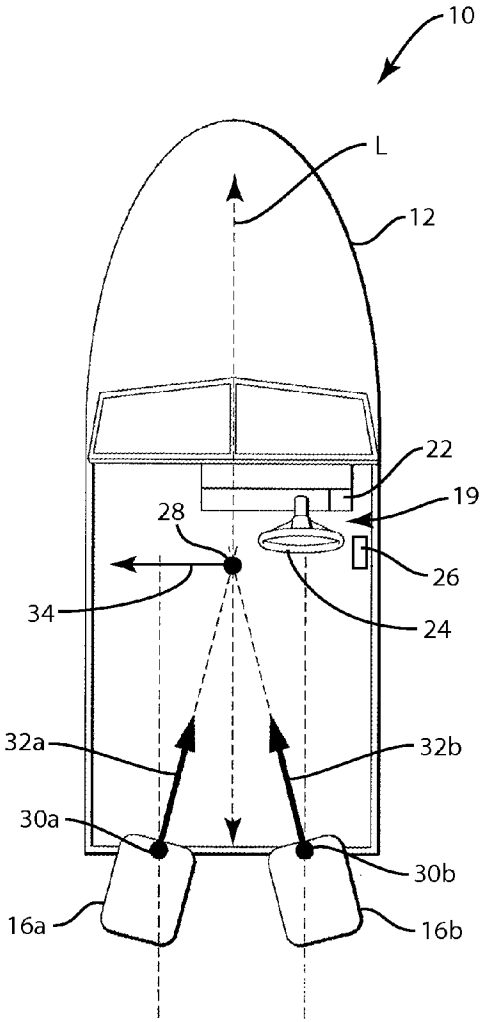
FIG. 2 is a schematic depiction of a marine vessel having a plurality of marine propulsion devices in an unaligned position.

In the present description, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives and modifications are possible within the scope of the appended claims. Each limitation in the appended claims is intended to invoke interpretation under 35 U.S.C. §112, sixth paragraph only if the terms "means for" or "step for" are explicitly recited in the respective limitation.

FIGS. 1-6 schematically depict components of a system 10 for maneuvering and orienting a marine vessel 12. The system 10 includes among other things a controller 14 (see FIG. 6) for controlling the rotational position and operation of a plurality of marine propulsion devices 16*a*, 16*b* based upon inputs from an input device. It should be understood that the particular configurations of the system 10 and marine vessel 12 are exemplary. It is possible to apply the concepts described in the present disclosure with substantially different configurations for systems for maneuvering and orienting marine vessels and with substantially different marine vessels.

For example, the controller 14 is shown in simplified schematic form and has a plurality of command control sections 18*a*, 18*b*, 18*c* located at a helm 19 of the marine vessel 12 that communicate with respective engine control sections 20*a*,

20*b* associated with each marine propulsion device 16*a*, 16*b* and steering control sections 21*a*, 21*b* associated with steering actuators 23*a*, 23*b* for steering each marine propulsion device 16*a*, 16*b*. However, the controller 14 can have any number of sections (including for example one section) and can be located remotely from or at different locations in the vessel 12 from that shown. It should also be understood that the concepts disclosed in the present disclosure are capable of being implemented with different types of control systems including systems that acquire global position data and real time positioning data, such as for example global positioning systems, inertial measurement units, and the like.

Further, certain types of input devices such a joystick 22, a steering wheel 24 and shift/throttle lever 26 are described. It should be understood that the present disclosure is applicable with other types of input devices such as touch screens, video screens, touch pads, voice command modules, and the like. It should also be understood that the concepts disclosed in the present disclosure are able to function in a preprogrammed format without user input or in conjunction with different types of input devices, as would be known to one of ordinary skill in the art. Further equivalents, alternatives and modifications are also possible as would be recognized by one of ordinary skill in the art.

Further, a marine vessel 12 having two (i.e. first and second) marine propulsion devices 16*a*, 16*b* is described; however the concepts in the present disclosure are applicable to marine vessels having any number of marine propulsion devices. The concepts in the present disclosure are also applicable to marine vessels having any type or configuration of propulsion device, such as for example electric motors, internal combustion engines, and/or hybrid systems configured as an inboard drives, outboard drives, inboard/outboard drives, stern drives, and/or the like. The propulsion devices could include propellers, impellers, pod drives, and/or the like.

Figure 1:
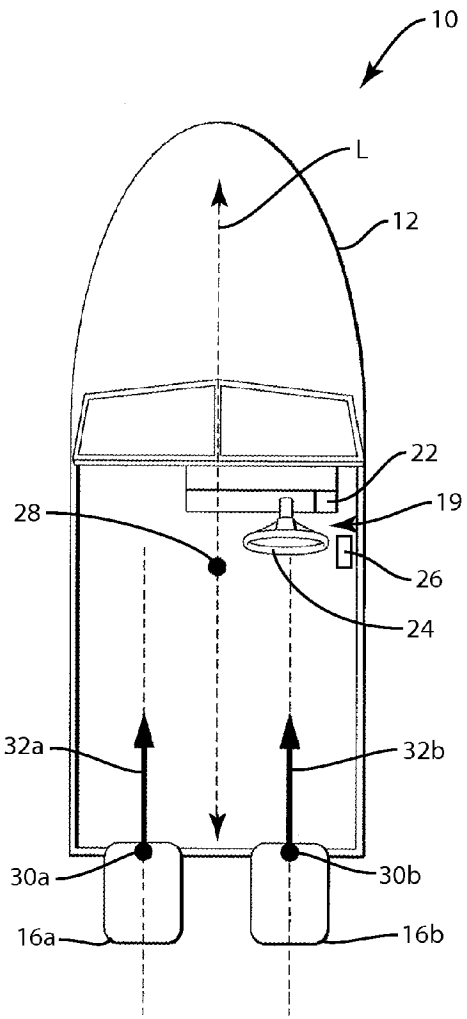
FIG. 1 is a schematic depiction of a marine vessel having a plurality of marine propulsion devices in an aligned position.

In FIGS. 1 and 2, a marine vessel 12 is schematically illustrated and has first and second marine propulsion devices 16*a*, 16*b*, which in the example shown are outboard internal combustion engines. The marine propulsion devices 16*a*, 16*b* are each rotatable in clockwise and counterclockwise directions through a substantially similar range of rotation about respective first and second steering axes 30*a*, 30*b*. Rotation of the marine propulsion devices 16*a*, 16*b* is facilitated by conventional steering actuators 23*a*, 23*b* (see FIG. 6). Steering actuators for rotating marine propulsion devices are well known in the art, examples of which are provided in the incorporated U.S. Pat. No. 7,467,595. Each marine propulsion device 16*a*, 16*b* creates thrust in either a forward or backward direction. FIGS. 1 and 2 show both marine propulsion devices 16*a*, 16*b* providing forward thrusts 32*a*, 32*b*; however it should be recognized that either or both propulsion devices 16*a*, 16*b* could instead provide backward thrusts.

As shown in FIG. 1, the propulsion devices 16*a*, 16*b* are aligned in a longitudinal direction L to thereby define parallel thrust vectors 32*a*, 32*b* extending in the longitudinal direction L. The particular orientation shown in FIG. 1 is typically employed to achieve either a forward or backward movement of the marine vessel 12 in the longitudinal direction L or a rotational movement of the marine vessel 12 with respect to the longitudinal direction L. Specifically, application of both thrust vectors 32*a*, 32*b* forwardly in the longitudinal direction L (such as is shown in FIG. 1) causes the marine vessel 12 to move forward in the longitudinal direction L. Conversely, application of thrust vectors 32*a*, 32*b* rearwardly in the longitudinal direction L (i.e. oppositely of the orientation shown in FIG. 1) causes the marine vessel 12 to move rearwardly in the longitudinal direction L. Further, opposite application of respective thrust vectors 32*a*, 32*h* (i.e. one forwardly and one rearwardly) causes rotation of the marine vessel 12 about a center of turn 28 for the marine vessel 12 and with respect to the longitudinal direction L. In this example, forward application of thrust 32*a* and rearward application of thrust 32*b* causes clockwise rotation of the marine vessel 12 about the center of turn 28, whereas rearward application of thrust 32*a* and forward application of thrust 32*b* causes counter-clockwise rotation of marine vessel about the center of turn 28. Various other maneuvering strategies and mechanisms are described in the incorporated U.S. Pat. Nos. 6,234,853; 7,267,068; and 7,467,595.

In this example, the center of turn 28 represents an effective center of gravity for the marine vessel 12. It will be understood by those having ordinary skill in the art that the location of the center of turn 28 is not, in all cases, the actual center of gravity of the marine vessel 12. That is, the center of turn 28 can be located at a different location than the actual center of gravity that would be calculated by analyzing the weight distribution of the various components of the marine vessel. Maneuvering a marine vessel 12 in a body of water results in reactive forces exerted against the hull of the vessel 12 by the wind and the water. For example, as various maneuvering thrusts are exerted by the first and second marine propulsion devices 16*a*, 16*b* the hull of the vessel 12 pushes against the water and the water exerts a reaction force against the hull. As a result, the center of turn identified as point 28 in FIGS. 1 and 2 can change in response to different sets of forces and reactions exerted on the hull of the marine vessel 12. This concept is recognized by those skilled in the art and is referred to as the instantaneous center of turn in U.S. Pat. No. 6,234,853 and as the instantaneous center in U.S. Pat. No. 6,994,046.

As shown in FIG. 2, the marine propulsion devices 16*a*, 16*b* are rotated away from the aligned position shown m FIG. 1 so that the marine propulsion devices 16*a*, 16*b* and resultant non-parallel thrust vectors 32*a*, 32*b* are not aligned in the longitudinal direction L. In the example shown in FIG. 2, the marine propulsion devices 16*a*, 16*b* are operated so as to provide the same or different forward thrust vectors 32*a*, 32*b* that each intersect with the effective center of gravity 28 so as to achieve a transverse movement along a resultant thrust vector 34. In this orientation, all movement of the marine vessel 12 would occur without rotation of the vessel 12 about the center of turn 28, with the movement of the vessel 12 resulting from the amounts and respective difference of thrust vectors 32*a*, 32*b*. In addition to the example shown in FIG. 2, various the unaligned positions of the marine propulsion devices 16*a*, 16*b* are possible to achieve one or both of a rotational and movement of the vessel 12 in an direction, including transversely to and along the longitudinal direction L. For example, the marine propulsion devices 16*a*, 16*b* do not have to be similarly oriented and could splay outwardly instead of inwardly to achieve desired movement of the vessel 12. As stated above, various other maneuvering strategies and mechanisms necessary to achieving same are described in the incorporated U.S. Pat. Nos. 6,234,853; 7,267,068; and 7,467,595.

The marine vessel 12 also includes a helm 19 where a user can input commands for maneuvering the marine vessel 12 via one or more input devices. As discussed above, the number and type of input devices can vary from the example shown. In FIGS. 1 and 2, the input devices include the joystick 22, steering wheel 24, and shift and throttle lever 26. Rotation of the steering wheel 24 in a clockwise direction requests clockwise rotation or yaw of the marine vessel 12 about the center of turn 28. Counterclockwise rotation of the steering wheel 24 requests counterclockwise rotation or yaw of the marine vessel 12 about the center of turn 28. Forward pivoting of the shift and throttle lever 26 away from a neutral position requests forward gear and requests increased throttle. Rearward pivoting of the shift and throttle lever 26 away from a neutral position requests reverse gear and requests increasing rearward throttle.

Figure 5:
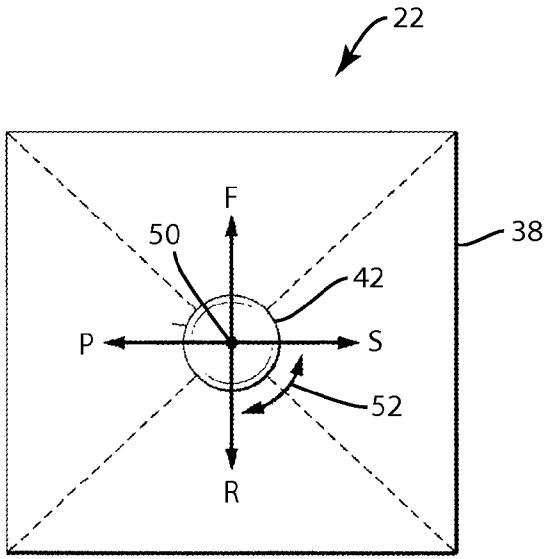
FIG. 5 is a top view of the joystick.
Figure 3:
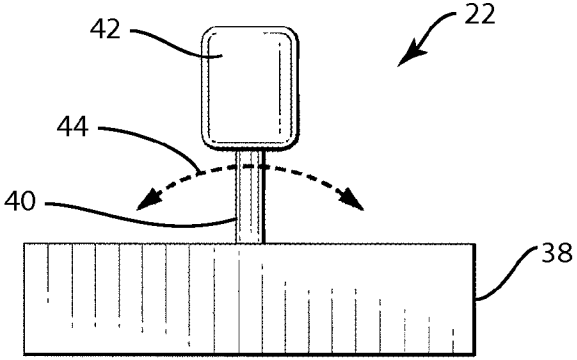
FIG. 3 is a side view of an input device in the form of a joystick.
Figure 4:
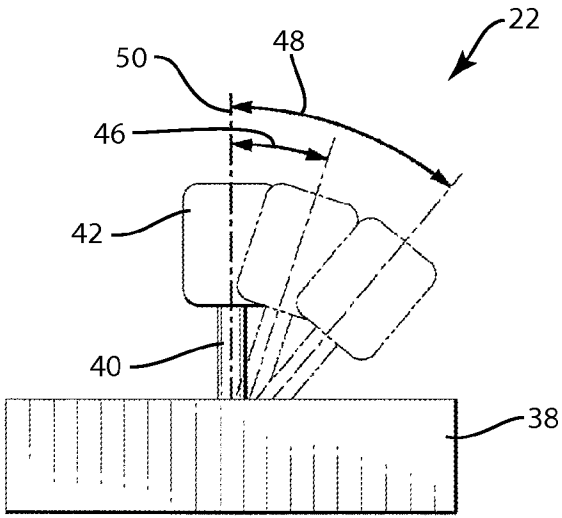
FIG. 4 is side view showing movement of the joystick.

A simplified schematic depiction of a joystick 22 is depicted in FIGS. 3-5. The joystick 22 includes a base 38, a shaft 40 extending vertically upwardly relative to the base 38, and a handle 42 located on top of the shaft 40. The shaft 40 is movable, as represented by dashed line arrow 44 in numerous directions relative to the base 38. FIG. 4 illustrates the shaft 40 and handle 42 in three different positions which vary by the magnitude of angular movement. Arrows 46 and 48 show different magnitudes of movement. The degree and direction of movement away from the generally vertical position shown in FIG. 3 represents an analogous magnitude and direction of an actual movement command selected by a user. FIG. 5 is a top view of the joystick 22 in which the handle 42 is in a central, vertical, or neutral, position. The handle 42 can be manually manipulated in a forward F, rearward R, port P or starboard S direction to provide actual movement commands into F, R, P, S directions or any other direction therebetween. In addition, the handle 42 can be rotated about the centerline 50 of the shaft 40 as represented by arrow 52 to request rotational movement or yaw of the vessel 12 about the center of turn 28. Clockwise rotation of the handle 42 requests clockwise rotation of the vessel 12 about the center of turn 28, whereas counterclockwise rotation of the handle 42 requests counterclockwise rotation of the vessel about the center of turn 28. Various other joystick structures and operations are described in the incorporated U.S. Pat. Nos. 6,234,853; 7,267,068; and 7,467,595.

Figure 6:
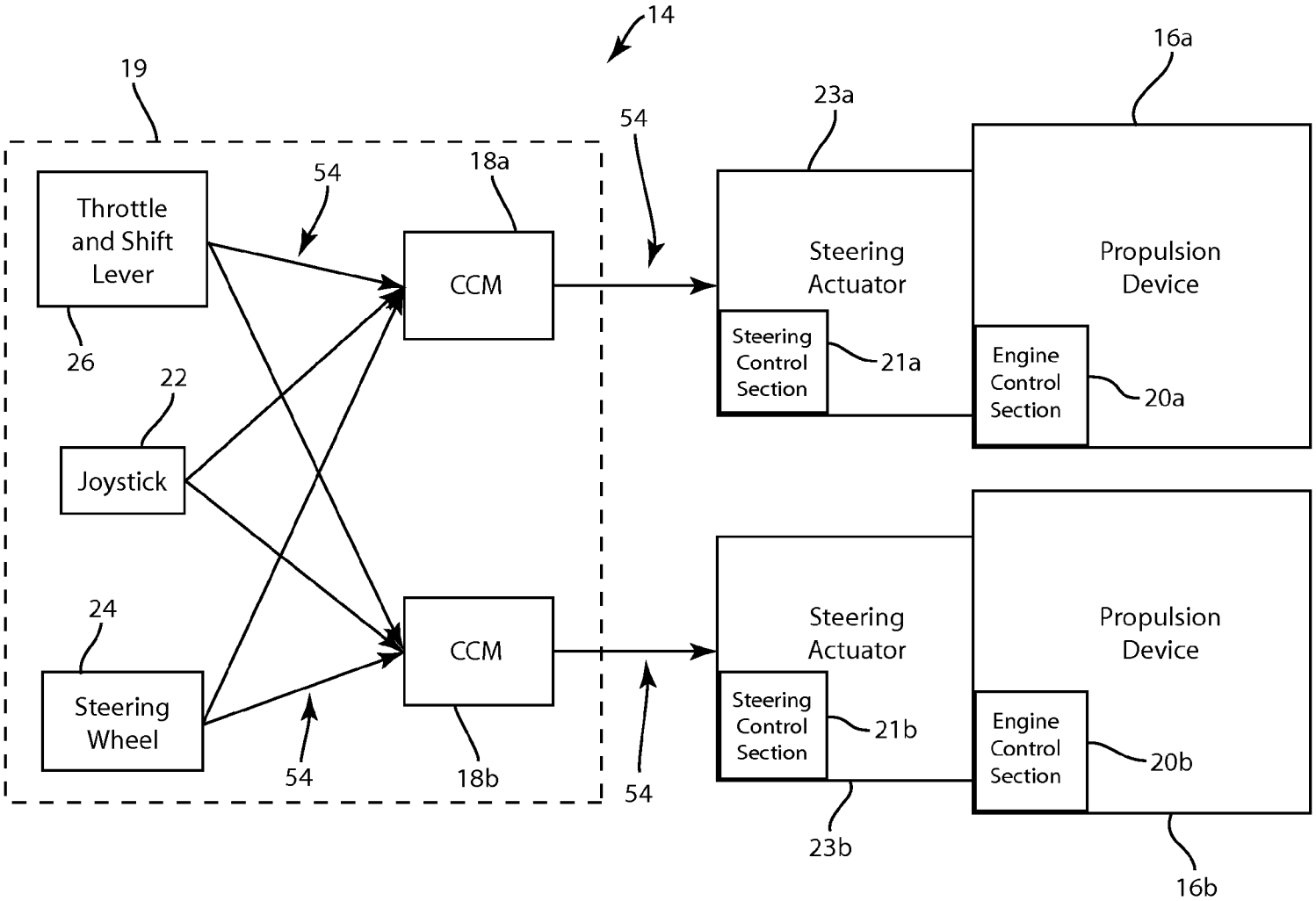
FIG. 6 is a schematic depiction of a controller for controlling a plurality of marine propulsion devices.

As depicted in FIG. 6, the input device 22 communicates with a controller 14 which in the example shown is part of a controller area network 54. The controller 14 is programmed to control operation of marine propulsion devices 16*a*, 16*b* and steering actuators 23*a*, 23*b* associated therewith. As discussed above, the controller 14 can have different forms. In the example shown, the controller 14 includes a plurality of command control sections 18*a*, 18*b* located at the helm 19. A command control section 18*a*, 18*b* is provided for each marine propulsion device 16*a*, 16*b*. The controller 14 also includes an engine control section 20*a*, 20*b* located at and controlling operation of each respective propulsion device 16*a*, 16*b* and a steering control section 21*a*, 21*b* located at and controlling operation of each steering actuator 23*a*, 23*b*. Each control section has a memory and processor for sending and receiving electronic control signals, for communicating with other controllers in the controller area network 54, and for controlling operations of certain components in the system 10 such as the operation and positioning of engine marine propulsion devices 16*a*, 16*b* and related steering actuators 23*a*, 23*b*. Examples of the programming and operations of the controller 14 and its sections are described in further detail below with respect to non-limiting examples and/or algorithms. While each of these examples/algorithms includes a specific series of steps for accomplishing certain system control functions, the scope of this disclosure is not intended to be bound by the literal order or literal content of steps described herein, and non-substantial differences or changes still fall within the scope of the disclosure.

In the example shown, each command control section 18*a*, 18*b* receives user inputs via the controller area network 54 from the joystick 22, steering wheel 24, and shift and throttle lever 26. Each command control section 18*a*, 18*b* is programmed to convert the user inputs into electronic commands and then send the commands to other controller sections in the system 10, including the engine control sections 20*a*, 20*b* and the steering control sections 21*a*, 21*b*. For example, when the shift and throttle lever 26 is actuated, as described above, each command control section 18*a*, 18*b* sends commands to the respective engine control sections 20*a*, 20*b* to achieve the requested change in throttle and/or shift. Further, when the steering wheel 24 is actuated, as described above, each command section 18*a*, 18*b* sends commands to the respective steering control sections 21*a*, 21*b* to achieve the requested change in steering. When the joystick 22 is moved out of its vertical position, each command section 18*a*, 18*b* sends commands to the respective engine control section 20*a*, 20*b* and/or steering control section 21*a*, 21*b* to achieve a movement commensurate with the joystick 22 movement. When the handle 42 of the joystick 22 is rotated, each command section 18*a*, 18*b* sends commands to the respective steering control section 21*a*, 21*b* to achieve the requested vessel yaw or rotation.

Movement of the joystick 22 out of its vertical position effectively engages a "joystick mode" wherein the controller 14 controls operation and positioning of the marine propulsion devices 16*a*, 16*b* based upon movement of the joystick 22. As explained above, each respective propulsion device 16*a*, 16*b* can move into and out of the aligned position shown in FIG. 1 when the joystick 22 is moved out of its vertical position. In this example, the controller 14 controls the plurality of marine propulsion devices 16*a*, 16*b* to move into an unaligned position, such as for example the position shown in FIG. 2 when the joystick 22 is moved out of its vertical position in a direction other than the longitudinal direction L to thereby request a transverse movement of the marine vessel 12. Once the marine propulsion devices 16*a*, 16*b* are moved into the unaligned position and operated to provide the thrusts 32*a*, 32*b* necessary to achieve the requested transverse movement, the marine propulsion devices 16*a*, 16*b* remain in the unaligned position despite movement of the joystick 22 back into its vertical position. In one example, the marine propulsion devices 16*a*, 16*b* remain in the unaligned position simply as a result of the controller 14 not providing any further movement commands to the steering actuators 23*a*, 23*b*, even if the joystick 22 is returned to its vertical position, as shown in FIGS. 3-5. The system 10 thus allows the user to input repetitive requests for transverse movement of the marine vessel 12 wherein the marine propulsion devices 16*a*, 16*b* do not return to the aligned position between such requests. This has been found to advantageously limit undesirable surge or backwards movement or rotation of the marine vessel 12. This example is particularly useful during docking procedures wherein the user repetitively taps the joystick 22 to request incremental transverse movements.

In further examples, the controller 14 is programmed to control movement of the plurality of marine devices 16*a*, 16*b* to remain in a last requested unaligned position when a new movement of the marine vessel 12 is requested in the longitudinal direction L, for example by moving the joystick 22 forwardly or rearwardly in the longitudinal direction L. That is, the newly requested longitudinal movement can be achieved while maintaining the marine propulsion devices 16*a*, 16*b* in an unaligned position by manipulation of the respective thrusts 32*a*, 32*b* instead of by aligning the marine propulsion devices 16*a*, 16*b* in the longitudinal direction L. In a further example, the above-described strategy can be limited to requests for longitudinal movement of the marine vessel 12 that are below a predetermined magnitude. That is, the controller 14 can be configured to control movement of the plurality of marine propulsion devices 16*a*, 16*b* into the aligned position shown in FIG. 1 when movement of the marine vessel 12 in the longitudinal direction L that is requested is above a predetermined magnitude.

A controller 14 can programmed such that further system requirements cause the marine propulsion devices 16*a*, 16*b* to move from an unaligned position to the aligned position shown in FIG. 1. For example, when the handle 42 of the joystick 22 is rotated to request rotational movement of the marine vessel 12, the controller 14 can be programmed to control movement of the marine propulsion devices 16*a*, 16*b* into the aligned position to achieve the requested rotational movement. In another example, the controller can be programmed to control movement of the plurality of marine propulsion devices 16*a*, 16*b* into the aligned position and thereafter remain in the aliened position when rotational movement of the vessel 12 is requested via rotation of the steering wheel 24. In a further example, the controller 14 can be programmed to control movement of the plurality of marine propulsion devices 16*a*, 16*b* into the aligned position and thereafter remain in the aliened position upon operation of the shift and throttle lever 26.

The system 10 and related controller 14 can include override protocol for the above-described routines when various other system inputs are provided. For example, if the operator engages an autopilot program, a weigh point tracking or station keeping program, or an auto heading program, the above control routine can be overridden by the controller 14. In other example, steering or engine faults that may influence thrust capabilities, multiple steering or engine faults that may influence thrust capabilities, emergency stop on one or more of the marine propulsion devices 16*a*, 16*b*, or key cycle events could override the above-described strategy.

Figure 7:
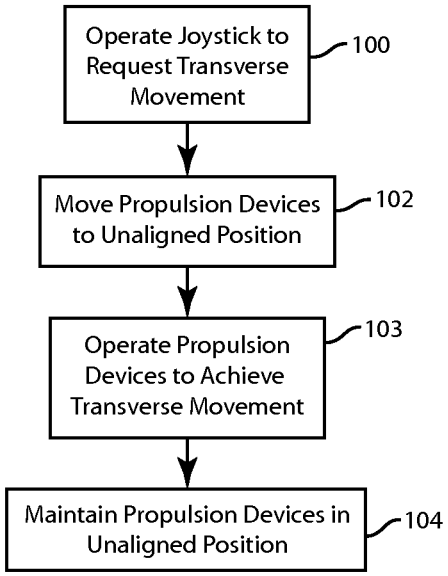
FIG. 7 is a flow chart depicting one example of a method of maneuvering a marine vessel.

Referring to FIG. 7, one example of a method of maneuvering a marine vessel is depicted. At step 100, an input device such as joystick 22 is operated to request a transverse movement of the marine vessel 12 with respect to the longitudinal direction L. At step 102, the controller 14 is operated to orient the plurality of marine propulsion devices 16*a*, 16*b* in an unaligned position necessary to achieve the requested transverse movement. One example of such an unaligned position is provided in FIG. 2. At step 103, the controller 14 is operated to control the propulsion devices 16*a*, 16*b* to produce thrusts 32*a*, 32*b* necessary to achieve the requested transverse movement. At step 104, the marine propulsion devices 16*a*, 16*b* remain in the unaligned position after the requested transverse movement is achieved.

Figure 8:
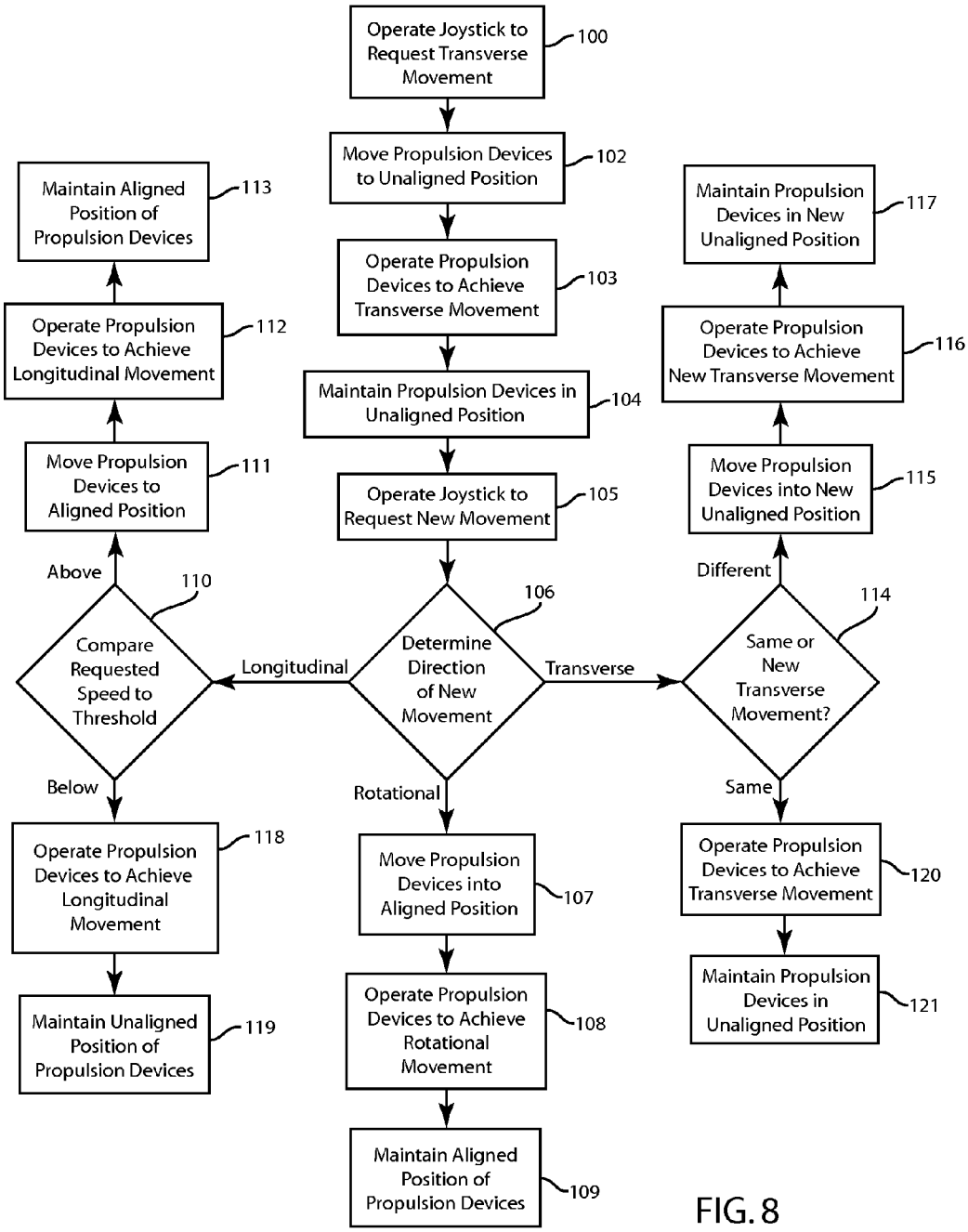
FIG. 8 is a flow chart depicting another example of a method of maneuvering a marine vessel.

Referring to FIG. 8, another example of a method of maneuvering a marine vessel is depicted. The example shown in FIG. 8 includes steps 100-104 described above with reference to FIG. 7. At step 105, the input device or joystick 22 is again operated to request movement of the marine vessel 12. At step 106, the movement of the joystick 22 is sensed and communicated to controller 14 in a conventional manner. The controller 14 thereafter determines the requested direction (and magnitude) of movement of the marine vessel 12. If the input device or joystick 22 is operated to request rotational movement of the marine vessel 12, at step 107 the controller 14 controls movement of the marine propulsion devices 16*a*, 16*b* into the aligned position shown in FIG. 1. At step 108, the controller 14 operates the propulsion devices 16*a*, 16*b* to achieve the requested rotational movement. At step 109, the controller 14 is configured to maintain the position of the propulsion devices 16*a*, 16*b* either through active control or by not sending any additional movement commands to steering control sections 21*a*, 21*b* and respective steering actuators 23*a*, 23*b*. Thereafter, the controller 14 awaits further input from the joystick 22, such as at step 100.

If at step 106 a longitudinal direction is determined to be requested, at step 110 the controller 14 is configured to compare the magnitude of movement requested to a threshold magnitude. If the requested magnitude is above the threshold magnitude, at step 111 the controller 14 is configured to control movement of the propulsion devices 16*a*, 16*b* into the aligned position shown in FIG. 1. At step 112, the controller controls operation of the marine propulsion devices 16*a*, 16*b* to achieve the requested longitudinal movement. At step 113, the marine propulsion devices 16*a*, 16*b* are maintained in aligned position. Thereafter, the controller 14 awaits further input from the joystick 22, such as at step 100. If the requested magnitude is below the threshold magnitude, at step 118 the marine propulsion devices 16*a*, 16*b* are operated to achieve the requested longitudinal movement. Thereafter, at step 119 the marine propulsion devices 16*a*, 16*b* are maintained in the unaligned position and the controller 14 awaits further input from the joystick 22, such as at step 105.

If at step 106 a transverse movement is determined to be requested, the controller 14 compares the new requested transverse movement to the previously requested transverse movement at step 114. If the new transverse movement is different than the previous transverse movement or if for example the center of turn 28 is determined to have moved since step 102, the controller 14 can optionally be configured to control movement of the marine propulsion devices 16*a*, 16*b* into a new unaligned position at step 115 and thereafter operate the propulsion devices to achieve the newly requested transverse movement at step 116. Thereafter, the marine propulsion devices 16*a*, 16*b* are maintained in the newly unaligned position by the controller 14 at step 116 and the controller awaits further input from the joystick 22, such as at step 105. If the new transverse movement that is requested is the same as the previous transverse movement, at step 120 the propulsion devices are operated to achieve the transverse movement because the marine propulsion devices were maintained in the unaligned position at step 104. At step 121, the propulsion devices 16*a*, 16*b* are maintained in the unaligned position and the controller 14 awaits further input from the joystick 22, such as at step 105.

What is claimed is:

1. A system for maneuvering a marine vessel, the system comprising:

an input device for requesting at least a transverse movement of the marine vessel with respect to a longitudinal direction;

a plurality of marine propulsion devices that are movable between at least an aligned position wherein the plurality of marine propulsion devices define thrust vectors that are parallel to each other and an unaligned position wherein the plurality of marine propulsion devices define thrust vectors that are not parallel to each other;

a controller that has a programmable circuit and that controls movement of the plurality of marine propulsion devices between the aligned and unaligned positions;

wherein upon operation of the input device to request transverse movement of the marine vessel the plurality of marine propulsion devices are moved into the unaligned position to achieve said transverse movement and thereafter remain in the unaligned position until further movement of the marine vessel is requested; and a shift lever for requesting a change in shift of at least one of the plurality of marine propulsion devices, wherein the controller controls movement of the plurality of marine propulsion devices into the aligned position upon operation of the shift lever, and to thereafter remain in the aligned position.

2. A method of maneuvering as marine vessel, the method comprising:

requesting transverse movement of the marine vessel with respect to a longitudinal direction and operating a controller to orient a plurality of marine propulsion devices into an unaligned position wherein the plurality of marine propulsion devices define thrust vectors that are not parallel to each other to thereby achieve the transverse movement, wherein the plurality of marine propulsion devices remain in the unaligned position after the transverse movement is achieved and until further movement of the marine vessel is requested; and operating the controller to align the plurality of marine propulsion devices in the longitudinal direction wherein the plurality of marine propulsion devices define thrust vectors that are parallel to each other when a shift lever is operated to request a change in shift of at least one of the plurality of marine propulsion devices.

* * * * *